US011782368B2

(12) United States Patent
Ikeno

(10) Patent No.: US 11,782,368 B2
(45) Date of Patent: Oct. 10, 2023

(54) HEATING UNIT

(71) Applicant: Brother Kogyo Kabushiki Kaisha, Nagoya (JP)

(72) Inventor: Yuichi Ikeno, Maibara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/651,970

(22) Filed: Feb. 22, 2022

(65) Prior Publication Data

US 2022/0276594 A1 Sep. 1, 2022

(30) Foreign Application Priority Data

Feb. 26, 2021 (JP) ..... 2021-029497

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2025; G03G 15/2053; G03G 2215/2003
See application file for complete search history.

(56) References Cited

U.S. PATENT DOCUMENTS

2015/0139708 A1* 5/2015 Shimura ..... G03G 15/2053 399/329
2016/0216659 A1 7/2016 Ikegami et al.
2019/0361379 A1 11/2019 Koyama

FOREIGN PATENT DOCUMENTS

JP 2016-139002 A 8/2016
JP 2017-072781 A 4/2017
JP 2019-203945 A 11/2019

* cited by examiner

*Primary Examiner* — Thomas S Giampaolo, II
(74) *Attorney, Agent, or Firm* — BURR PATENT LAW, PLLC

(57) ABSTRACT

A heating unit includes a heater including a substrate and a resistance heating element, an endless belt, a holder supporting the heater, and a heat conductive member. A contact region in which the heat conductive member and the heater are in contact with each other includes two end regions located on outer sides of a range in which the resistance heat element is disposed in the longitudinal direction and a central region located in the range in which the resistance heat element is disposed in the longitudinal direction. The two end regions respectively include a first end and a second end of the contact region in the longitudinal direction. Heat conductive grease is not provided in each of the two end regions, and is provided in the central region.

17 Claims, 5 Drawing Sheets

HEATING UNIT

CROSS REFERENCE TO RELATED APPLICATION

The present application claims priority from Japanese Patent Application No. 2021-029497, which was filed on Feb. 26, 2021, the disclosure of which is herein incorporated by reference in its entirety.

BACKGROUND

The following disclosure relates to a heating unit used for a fixing device of an image forming apparatus or the like In the past, there has been known a heating unit including an endless belt, a heater being in contact with an inner circumferential surface of the belt and having a substrate and a resistance heat element formed on the substrate, a supporter supporting the heater, a heat conductive member disposed between the heater and the supporter and configured to uniformize a temperature of the heater in a longitudinal direction of the heater. In the heating unit, grease is put on an entire region of the heat conductive member with which the heater is in contact, and the heater is put on the region of the heat conductive member so that the grease is interposed between the heater and the heat conductive member.

SUMMARY

Incidentally, in the heating unit, a sheet such as paper passes in a part of a region in which the resistance heat element is disposed in the longitudinal direction. Accordingly, it is necessary to improve heat uniformity of the heater in the longitudinal direction by the heat conductive member. That is, it is necessary to uniformize distribution of temperature of the heater in the longitudinal direction by the heat conductive member.

An aspect of the disclosure relates to a heating unit capable of improving heat uniformity in a region in which the resistance heat element is disposed in the longitudinal direction of the heater.

In one aspect of the disclosure, a heating unit includes a heater including a substrate and a resistance heating element provided on the substrate, an endless belt configured to rotate around the heater, a holder supporting the heater, and a heat conductive member located between a back surface of the heater and the holder, the heat conductive member having a heat conductivity greater than that of the substrate, a length of the heat conductive member in a longitudinal direction of the heater being greater than that of the resistance heat element. A contact region in which the heat conductive member and the heater are in contact with each other includes two end regions located on outer sides of a range in which the resistance heat element is disposed in the longitudinal direction, the two end regions respectively including a first end and a second end of the contact region in the longitudinal direction, heat conductive grease is not provided in each of the two end regions, and a central region located in the range in which the resistance heat element is disposed in the longitudinal direction, heat conductive grease is provided in the central region.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
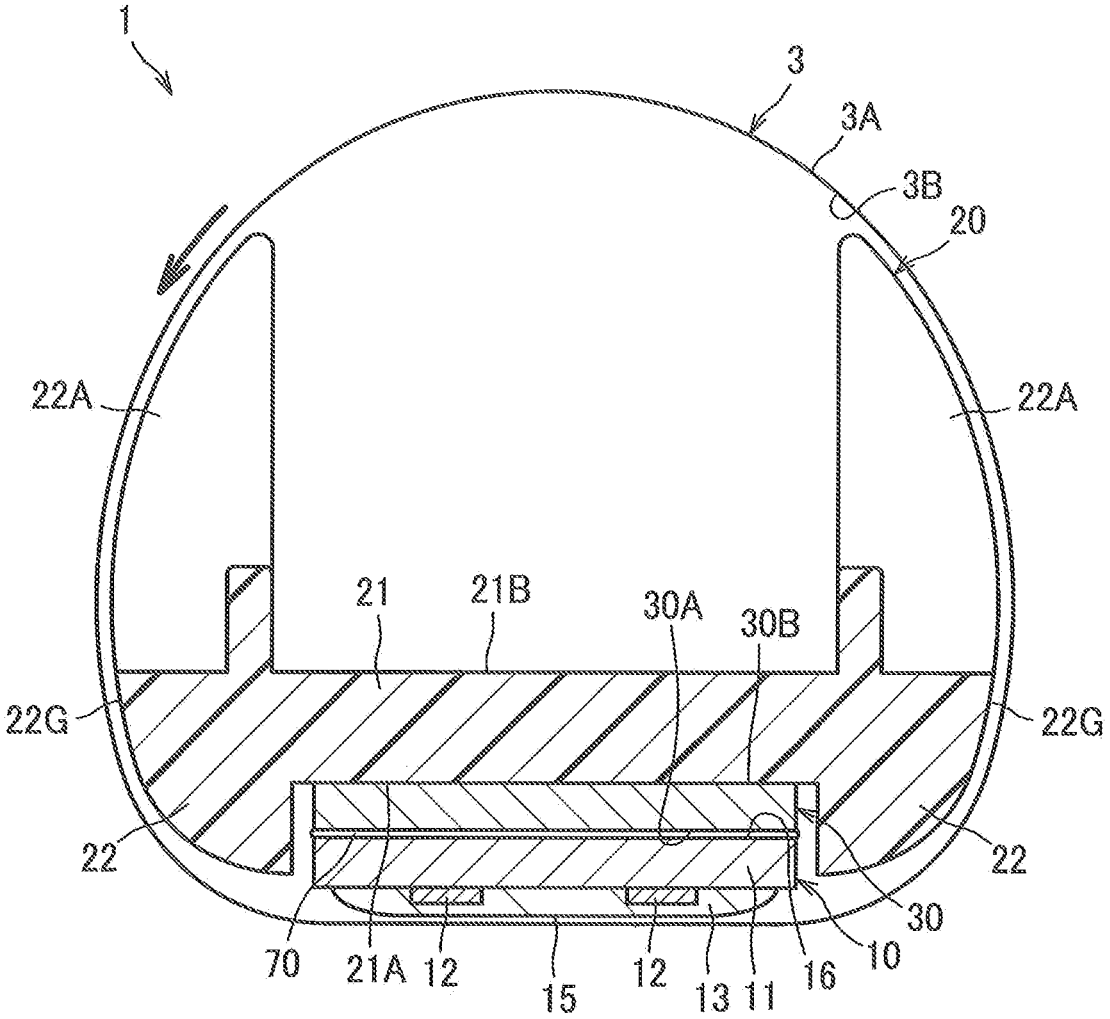
FIG. 1 is a cross-sectional view illustrating a configuration of a heating unit.
Figure 2A:
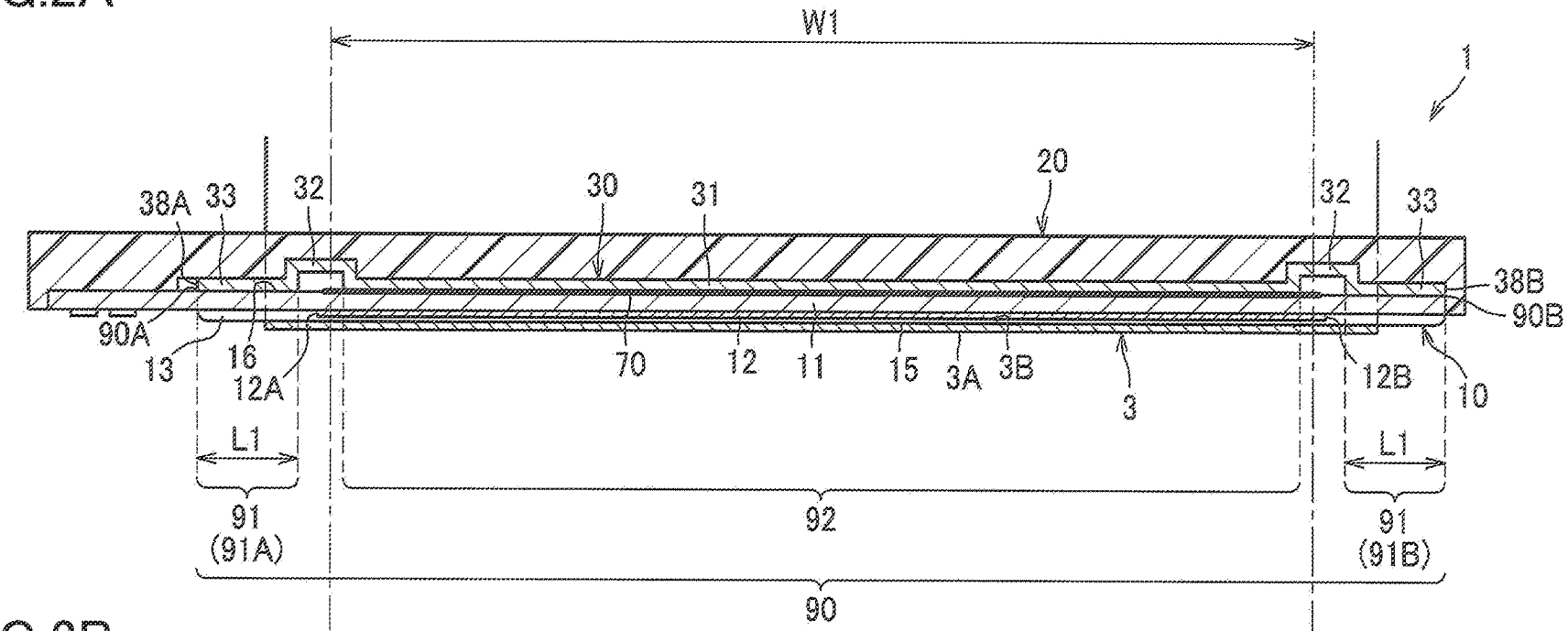
FIG. 2A is a cross-sectional view illustrating a configuration of the heating unit according to a first embodiment.
Figure 2B:
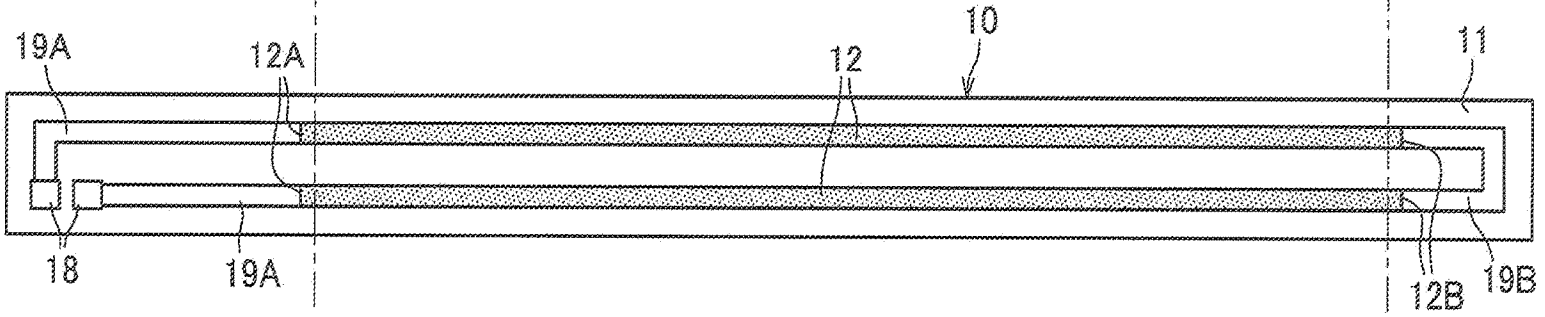
FIG. 2B is a configuration of a surface on which resistance heat elements of a heater is disposed.

There will be next described a first embodiment of this disclosure in detail with reference to FIGS. 1-2B. As illustrated in FIG. 1, a heating unit 1 is used for a fixing device of an electrophotographic type image forming apparatus, or a foil transferring apparatus that transfers foil by heat, and the like. The heating unit 1 includes a belt 3, a heater 10, a holder 20, a heat conductive member 30.

The belt 3 is an endless belt, which is made of metal or resin. The belt 3 rotates around the heater 10 while being guided by the holder 20. The belt 3 has an outer circumferential surface 3A and an inner circumferential surface 3B. The outer circumferential surface 3A comes into contact with a sheet to be heated. The inner circumferential surface 3B is in contact with a nip surface 15 of the heater 10.

The heater 10 includes a substrate 11, resistance heating elements 12 supported by the substrate 11, and a cover 13. Moreover, the heater 10 has the nip surface 15 with which the inner circumferential surface 3B is in contact, and a back surface 16 located on an opposite side to the nip surface 15.

The substrate 11 is formed of a long rectangular plate made of ceramic. The heater 10 is a so-called ceramic heater.

The resistance heating elements 12 are formed on one surface of the substrate 11 by printing. As illustrated in FIG. 2B, two resistance heating elements 12 are provided in the embodiment. The two resistance heating elements 12 are respectively disposed so as to extend in a longitudinal direction of the heater 10 (hereinafter the longitudinal direction of the heater 10 is referred to merely as "longitudinal direction") and so as to be spaced apart from each other in parallel in a short-side direction orthogonal to the longitudinal direction. A conducting wire 19A is connected to a first end 12A of each of the resistance heating elements 12, and a terminal 18 for supplying power is provided at an end portion of the conducting wire 19A of each of the resistance heating elements 12. Moreover, second ends 12B of the resistance heat elements 12 are connected to each other by a conductive wire 19B.

The first ends 12A and the second ends 12B of the resistance heating elements 12 are located on outer sides of a range in which the sheet with a maximum width W1 usable in the heating unit 1 passes. That is, a length of the resistance heating element 12 in the longitudinal direction is longer than the maximum width W1.

It is noted that the number of the resistance heating elements 12 is not particularly limited. Moreover, the resistance heating elements may be configured such that a resistance heating element in which a heat generation amount at the center in the longitudinal direction is greater than a heat generation amount at end portions in the longitudinal direction and a resistance heating element in which the heat generation amount at end portions in the longitudinal direction is greater than the heat generation amount at the center in the longitudinal direction are provided, and such that a heat generation distribution in the longitudinal direction is regulated by individually controlling each of the resistance heating elements.

Returning to FIG. 1, the cover 13 covers the resistance heating elements 12. The cover 13 is made of, for example, glass or the like.

The holder 20 is a member supporting the heater 10. The holder 20 includes a support portion 21 and guide portions 22. The support portion 21 has a plate shape corresponding to a shape of the heater 10. The support portion 21 has a support surface 21A facing a side on which the heater is disposed, and an inner-side surface 21B located on an opposite side to the support surface 21A.

The guide portions 22 are provided at both ends of the support portion 21 in the short-side direction. Each of the guide portions 22 has a guide surface 22G extending along the inner circumferential surface of the belt 3. The guide portions 22 have a plurality of guide ribs 22A arranged in the longitudinal direction.

The heat conductive member 30 is a member configured to uniformize the temperature of the heater 10 in the longitudinal direction by conducting heat in the longitudinal direction of the heater 10. The heat conductive member 30 is a sheet-like member, and is located between the back surface 16 of the heater 10 and the support portion 21 of the holder 20. When the sheet as a heating target is interposed between other pressure members, the heat conductive member 30 is interposed between the heater 10 and the support portion 21. The heat conductive member 30 includes a heater-side surface 30A which is in contact with the back surface 16 of the heater 10, and an opposite surface 30B located on an opposite side to the heater-side surface 30A. The opposite surface 30B is in contact with the support surface 21A of the support portion 21.

The heat conductive member 30 is a member in which a heat conductivity in a direction parallel to the heater-side surface 30A (hereinafter referred to merely as "planar direction") is higher than a heat conductivity of the substrate 11 in the planar direction. A material of the heat conductive member 30 is not particularly limited. For example, metals such as aluminum, aluminum alloys, and copper having high heat conductivities can be adopted, and a metal plate is an example of the heat conductive member 30. Moreover, it is preferable that the heat conductive member 30 is an anisotropic heat conductive member in which the heat conductivity in the planar direction is higher than a heat conductivity in a thickness direction orthogonal to the heater-side surface 30A. For example, a graphite sheet can be adopted as the anisotropic heat conductive member. Moreover, a thickness of the heat conductive member 30 is not particularly limited either. For example, a film-like member thinner than 0.1 mm and a plate-like member thicker than 1 mm may be adopted. In a case where the thickness of the heat conductive member 30 is greater than 1 mm, the heat conductive member 30 may be a metal plate.

As illustrated in FIG. 2A, the first end 38A and the second end 38B of the heat conductive member 30 are located on outer sides of the first ends 12A and the second ends 12B of the resistance heating element 12 in the longitudinal direction. That is, a length of the heat conductive member 30 is longer than the length of the resistance heat element 12 in the longitudinal direction. It is noted that the length of the heat conductive member 30 in the longitudinal direction is less than a length of the substrate 11 in the longitudinal direction. That is, the length of the heat conductive member 30 is less than that of a heater 10 in the longitudinal direction. A length of the holder 20 is longer than a length of the heater 10 in the longitudinal direction.

A contact region 90 in which the back surface 16 of the heater 10 and the heat conductive member 30 are in contact with each other includes two end regions 91 and a central region 92.

The end regions 91 are located on outer sides of the resistance heat elements 12 in the longitudinal direction in the contact region 90, and the end regions 91 are regions respectively include a first end 90A and a second end 90B of the contact region 90 in the longitudinal direction. Specifically, the end regions 91 include the first end region 91A located at a first end in the longitudinal direction and the second end region 91B located at a second end in the longitudinal direction.

The first end region 91A is located on an outer side of the first end 12A of the resistance heat elements 12 in the longitudinal direction, and is a region including the first end 90A of the contact region 90. More specifically, the first end region 91A is a region extending from the first end 90A of the contact region 90 toward an inner side of the contact region 90 in the longitudinal direction by a predetermined length L1. Moreover, the second end region 91B is located on an outer side of the second end 12B of the resistance heat elements 12 in the longitudinal direction, and is a region including the second end 90B of the contact region 90. More specifically, the second end region 91B is a region extending from the second end 90B of the contact region 90 toward the inner side of the contact region 90 in the longitudinal direction by the predetermined length L1.

The predetermined length L1 is less than a distance between a position of the first end 90A of the contact region 90 and a position of the first end 12A of the resistance heat elements 12 in the longitudinal direction. The predetermined length L1 is less than a distance between a position of the second end 90B of the contact region 90 and a position of the second end 12B of the resistance heat elements 12 in the longitudinal direction.

Moreover, the end regions 91 are located on outer sides of the range in which the sheet with the maximum width W1 usable in the heating unit 1 passes in the longitudinal direction. That is, the end regions 91 are located in ranges in which the sheet does not pass the heating unit 1 in the longitudinal direction.

The central region 92 is a region located between the end regions 91 in the longitudinal direction in the contact region 90. The central region 92 is located in a range in which the resistance heat elements 12 are disposed in the longitudinal direction. Specifically, the central region 92 is located on an inner side of the first end 12A and the second end 12B of the resistance heat elements 12 in the longitudinal direction.

Moreover, the central region 92 is located at a position corresponding to the range in which the sheet with the maximum width W1 passes in the longitudinal direction. In the present embodiment, the central region 92 is located in the range in which the sheet with the maximum width W1 passes in the longitudinal direction. That is, in the present embodiment, a length of the central region 92 is less than the maximum width W1 in the longitudinal direction.

The heat conductive member 30 includes a first portion 31, two second portions 32, and two third portions 33.

The first portion 31 is a portion located at a position corresponding to the central region 92 in the longitudinal direction. The first portion 31 is located on the inner side of the first end 12A and the second end 12B of the resistance heat elements 12 in the longitudinal direction. The first portion 31 is in contact with the back surface 16 of the heater 10. In the present embodiment, a region in which the back surface 16 of the heater 10 and the first portion 31 are in contact with each other is the central region 92.

The second portions 32 are portions located on the outer sides of the first portion 31 in the longitudinal direction. The second portions 32 are not in contact with the back surface 16 of the heater 10. Specifically, the second portions 32 are formed so that a part of a sheet-shaped member constituting the heat conductive member 30 is bent so as to have a U-shape such that the part protrudes in a direction moved away from the back surface 16 of the heater 10. The second portions 32 are opposed to the back surface 16 of the heater 10 with a space therebetween. In the present embodiment, the second portions 32 are located at the same positions as the first end 12A and the second end 12B of the resistance heat elements 12 in the longitudinal direction.

The third portions 33 are portions located on outer sides of the second portions 32 in the longitudinal direction. The third portions 33 are located on the outer sides of the first end 12A and the second end 12B of the resistance heat elements 12 in the longitudinal direction. Moreover, the third portions 33 are located at positions corresponding to the end regions 91 in the longitudinal direction. The third portions 33 are in contact with the back surface 16 of the heater 10. In the present embodiment, regions in which the back surface 16 of the heater 10 and the third portions 33 are in contact with are the end regions 91.

In the heating unit 1, heat conductive grease 70 is provided in the central region 92 in the contact region 90. In the contact region 90, the heat conductive grease 70 is not provided in the end regions 91. Specifically, the heat conductive grease 70 is interposed between the back surface 16 of the heater 10 and the first portion 31. The heat conductive grease 70 is not interposed between the back surface 16 of the heater 10 and the third portions 33.

In the heating unit 1, the heat conductive grease 70 is put on the first portion 31 of the heat conductive member 30, and the heater 10 is disposed on the heat conductive member 30. Accordingly, the heat conductive grease 70 is interposed between the back surface 16 of the heater 10 and the first portion 31 of the heat conductive member 30. The heat conductive grease 70 is not put on the third portions 33.

It is noted that the heat conductive grease 70 may be put on an entire of the central region 92, and may be put on a part of the central region 92. Moreover, as illustrated in FIG. 2A, a portion of the heat conductive grease 70 may be squeezed from between the heater 10 and the first portion 31, and may be inserted into a space between the heater 10 and the second portions 32. Moreover, the heat conductive grease 70 may be interposed only between the heater 10 and the first portion 31.

According to the above described first embodiment, since the heat conductive grease 70 is interposed between the back surface 16 of the heater 10 and the central region 92 in the contact region 90, it is possible to improve heat transfer between the heater 10 and the heat conductive member 30 in the central region 92 through the heat conductive grease 70. Accordingly, it is possible to improve heat uniformity in which distribution of temperature is uniformized by the heat conductive member 30 in the longitudinal direction in a region in which the resistance heat elements 12 is disposed in the longitudinal direction.

Especially, since the heat conductive grease 70 is interposed between the heater 10 and the first portion 31, it is possible to improve the heat transfer between the heater 10 and the heat conductive member 30 in a region in which the first portion 31 is disposed through the heat conductive grease 70.

Moreover, the heat conductive member 30 includes the second portions 32 located on the outer sides of the first portion 31 located at the position corresponding to the central region 92 in the longitudinal direction and the second portions are not in contact with the heater 10, it is possible to suppress heat in the heater 10 from transferring from the second portions 32 to the heat conductive member 30. Accordingly, it is possible to improve the heat transfer between the heater 10 and the heat conductive member 30 in the region in which the first portion 31 is disposed.

Moreover, since the second portions 32 are opposed to the back surface 16 of the heater 10 with the space therebetween, it is possible to cause the second portions 32 not to be in contact with the back surface 16 of the heater 10. Moreover, since there is the space between the heater 10 and each of the second portions 32, it is possible to store the heat conductive grease 70 squeezed from between the heater 10 and the first portion 31 in the space between the heater 10 and each of the second portions 32. Accordingly, it is possible to suppress the heat conductive grease 70 from being inserted into between the heater 10 and the third portions 33 in the middle of using the heating unit 1.

Moreover, since the heat conductive member 30 includes the third portions 33 located on the outer sides of the second portions 32 in the longitudinal direction and the third portions 33 are in contact with the heater 10, it is possible to release heat in end portions of the heater 10 in the longitudinal direction to the third portions 33 of the heat conductive member 30. Accordingly, it is possible to suppress excessive increase of temperature in end portions of the heater 10 and the belt 3.

Especially, since the end regions 91 (the third portions 33) is located on the outer side of the range in which the sheet with the maximum width W1 passes in the longitudinal direction, it is possible to release heat in a region of the heater 10 and the belt 3 located on the outer side of the range in which the sheet with the maximum width W1 passes to the heat conductive member 30. Accordingly, it is possible to suppress excessive increase of temperature in the region of the heater and the belt 3 located on the outer side of the range. That is, it is possible to suppress the excessive increase of temperature at a position of the heater 10 and the belt 3 corresponding to the position in which the sheet does not pass in the longitudinal direction.

Moreover, since the heat conductive member 30 has a sheet shape, it is possible to reduce a heat capacity of the heat conductive member 30. Accordingly, since a temperature of a portion of the belt 3 with which the heater 10 is in contact can be increased quickly by the heater 10, it is possible to shorten a start-up period of the heating unit 1.

There will be next described a second embodiment. It is noted that there will be described different elements from the first embodiment in the following description in details, and, for example, the same reference numerals as used in the first embodiment are used to designate the corresponding elements of the second embodiment, and an explanation of which is dispensed with.

Figure 3:
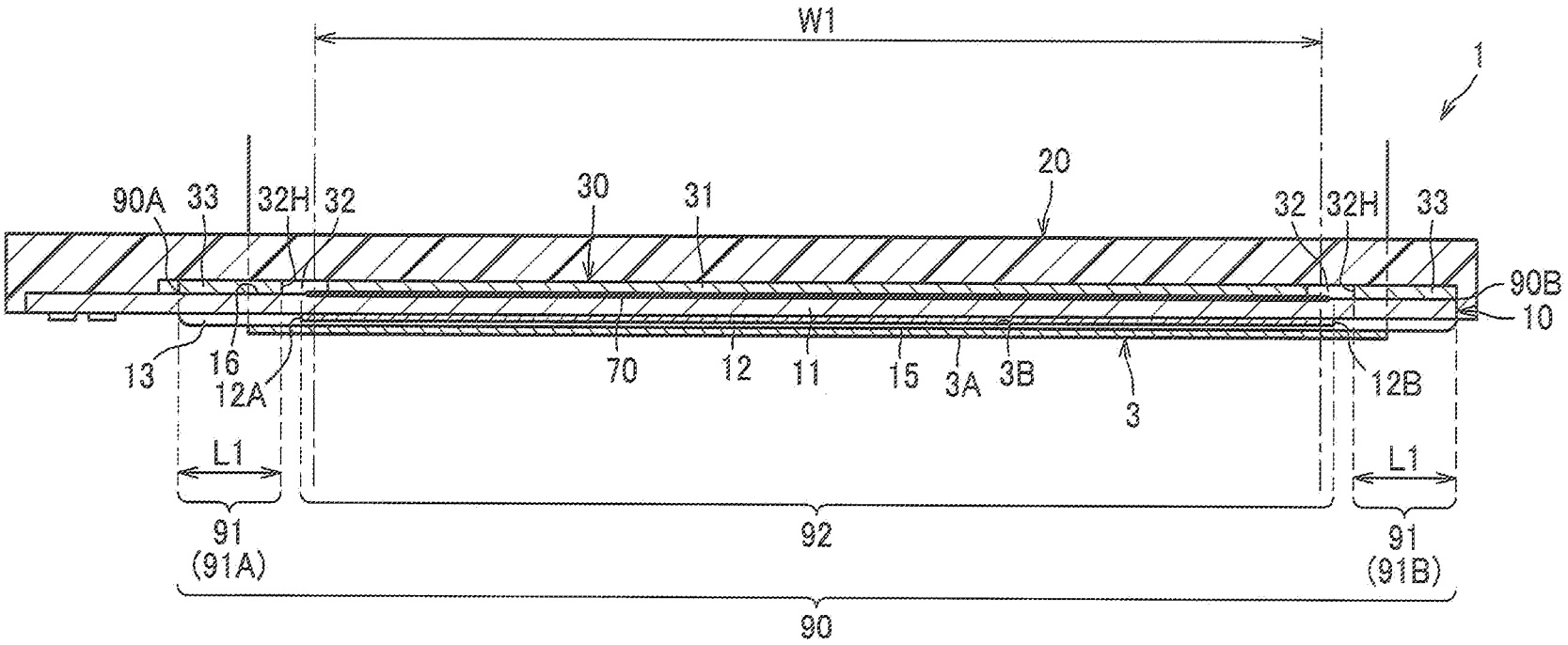
FIG. 3 is a cross-sectional view illustrating a configuration of a heating unit according to a second embodiment.
Figure 4:
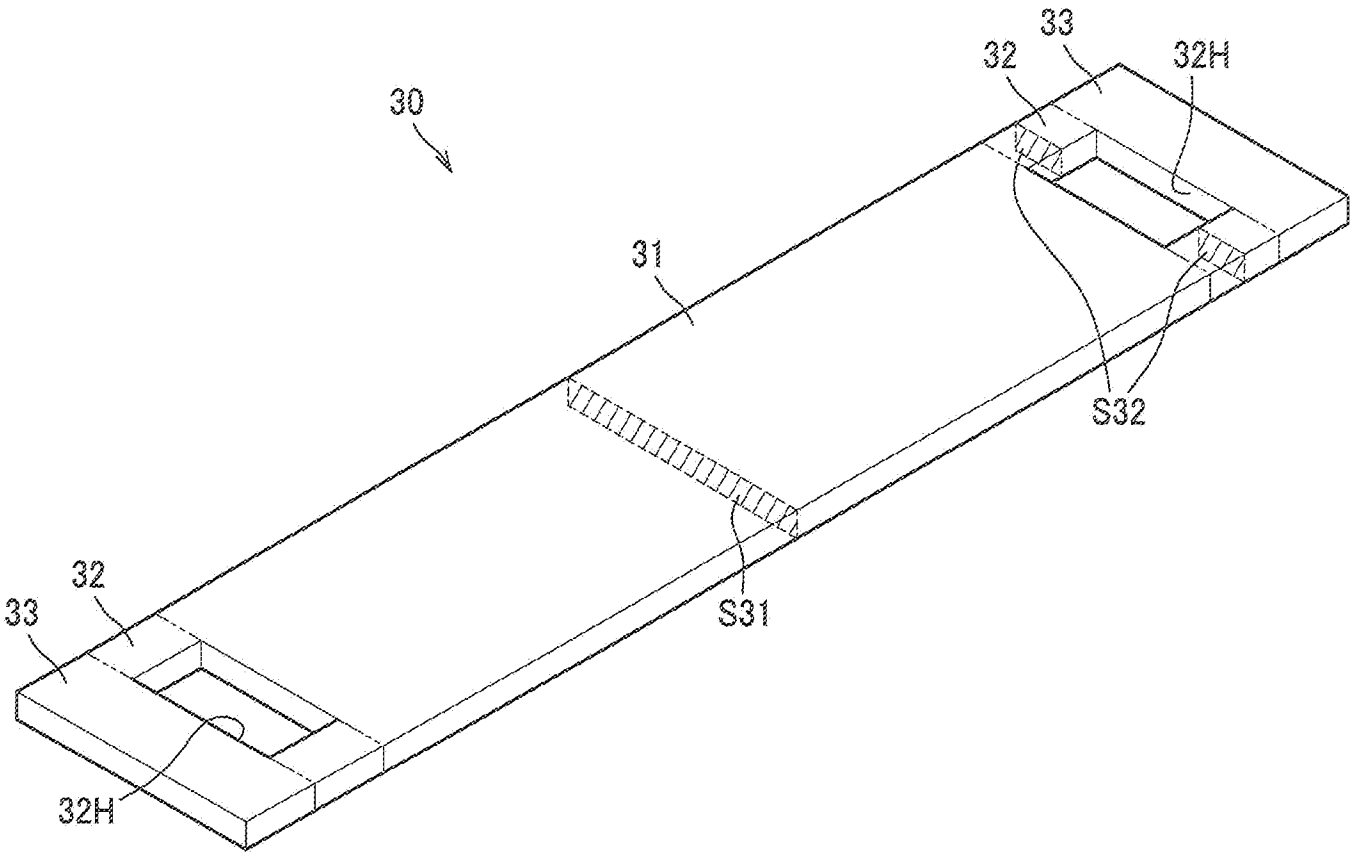
FIG. 4 is a perspective view illustrating a configuration of a heat conductive member according to the second embodiment.

As illustrated in FIG. 3 and FIG. 4, the heat conductive member 30 includes the first portion 31, the two second portions 32, and the two third portions 33. As illustrated in FIG. 4, the heat conductive member 30 has a flat sheet shape without being bent, and a length of the heat conductive member 30 in the short-side direction orthogonal to the longitudinal direction of the heat conductive member 30 is approximately constant in the longitudinal direction. Moreover, the length of the first portion 31 in the longitudinal direction is longer than a length of each of the second portions 32 in the longitudinal direction.

Each of the second portions 32 has a hole 32H piercing the second portion 32 and having a rectangular shape. Each of the holes 32H is adjacent to outer ends of the first portion 31 and inner ends of the third portions 33 in the longitudinal direction. In each of the second portions 32, portions located on both sides of the hole 32H in the short-side direction of the heat conductive member 30 are in contact with the back surface 16 of the heater 10.

A cross-sectional area S32 of a cross section orthogonal to the longitudinal direction of the second portions 32 is less than a cross-sectional area S31 of a cross section orthogonal to the longitudinal direction of the first portion 31. That is, a contact area in which the second portions 32 and the back surface 16 of the heater 10 are in contact with each other per unit length in the longitudinal direction is less than a contact area in which the first portion 31 and the back surface 16 of the heater 10 are in contact with each other per unit length in the longitudinal direction.

It is noted that, in a case where, for example, a not-illustrated through hole or a not-illustrated cutout for providing a temperature detecting member such as a thermistor or a thermostat is provided to the first portion 31, the cross section orthogonal to the longitudinal direction of the first portion 31 is a cross section orthogonal to the longitudinal direction located at a position in the longitudinal direction where the through hole or the cutout is not provided.

As illustrated in FIG. 3, in the contact region 90, the central region 92 is located on the inner side of the first end 12A and the second end 12B of the resistance heat elements 12 in the longitudinal direction. In the present embodiment, a region in which the back surface 16 of the heater 10 and the first portion 31 are in contact with each other and a part of a region in which the back surface 16 of the heater 10 and the second portions 32 are in contact with each other (a region located on the inner side of the first end 12A and the second end 12B of the resistance heat elements 12 in the longitudinal direction) are the central region 92. Moreover, in the present embodiment, a length of the central region 92 in the longitudinal direction is longer than the maximum width W1.

Moreover, in the contact region 90, the end regions 91 are located on the outer sides of the first end 12A and the second end 12B of the resistance heat elements 12 in the longitudinal direction. In the longitudinal direction, each of lengths of the end regions 91 from the first end 90A and the second end 90B of the contact region 90 is the predetermined length L1. In the present embodiment, regions in which the back surface 16 of the heater 10 and the third portions 33 are in contact with each other are the end regions 91.

The heat conductive grease 70 is provided in the central region 92 in the contact region 90. The heat conductive grease 70 is not provided in the end regions 91 in the contact region 90. Specifically, the heat conductive grease 70 is interposed between a portion of the first portion 31 and the second portions 32 located on the inner side of the first end 12A and the second end 12B of the resistance heat elements 12 in the longitudinal direction and the back surface 16 of the heater 10. Moreover, the heat conductive grease 70 is not interposed between the third portions 33 and the back surface 16 of the heater 10.

It is noted that the heat conductive grease 70 may be interposed only between the first portion 31 and the heater 10. Moreover, the heat conductive grease 70 may not be interposed between a portion of the second portions 32 located on the outer side of the first end 12A and the second end 12B of the resistance heat elements 12 in the longitudinal direction and the back surface 16 of the heater 10 (see FIG. 3), and may be interposed between the portion of the second portions 32 and the back surface 16 of the heater 10.

According to the above described second embodiment, it is possible to achieve the same effects as the first embodiment.

Moreover, in the second embodiment, the second portions 32 are, different from the first embodiment, in contact with the heater 10, however, since a contact area of the second portions 32 is small, it is possible to suppress transfer of the heat in the heater 10 from the second portions 32 to the heat conductive member 30. Accordingly, it is possible to improve the heat transfer between the heater 10 and the heat conductive member 30 in a region in which the first portion 31, a contact area of which is large, is disposed.

Moreover, since the second portions 32 are configured so that the second portions 32 include the holes 32H, it is possible to easily form the second portions 32, the cross-sectional area of which is small, in the heat conductive member 30.

It is noted that, in the second embodiment, a single hole 32H is formed in each of the second portions 32, however, the present disclosure is not limited to this configuration. A plurality of holes are formed in each of the second portions 32. Moreover, a shape of the hole 32H may be an arbitrary shape, and is not limited to a rectangular shape. For example, the shape of the hole 32H may be a circle. Moreover, the hole 32H may be a hole (a recess) not piercing the second portion 32 and opening toward the heater 10, in place of the hole 32H piercing the second portion 32. Moreover, a cutout (a recess) in which an end of the second portion 32 in the short-side direction is cut out may be formed in each of the second portions 32, in place of the hole 32H.

There has been described the embodiments, however, the present disclosure is not limited to the above embodiments, and various modifications can be adopted as described below.

For example, the part of the sheet-shaped member is bent so as to form the heat conductive member 30 in the first embodiment, and the heat conductive member 30 has the holes 32H piercing the part of the flat sheet-shaped member in the second embodiment, however, the present disclosure is not limited to this configuration. For example, as illustrated in FIG. 5, the heat conductive member 30 may have a flat sheet shape in which the holes 32H are not provided.

Figure 5:
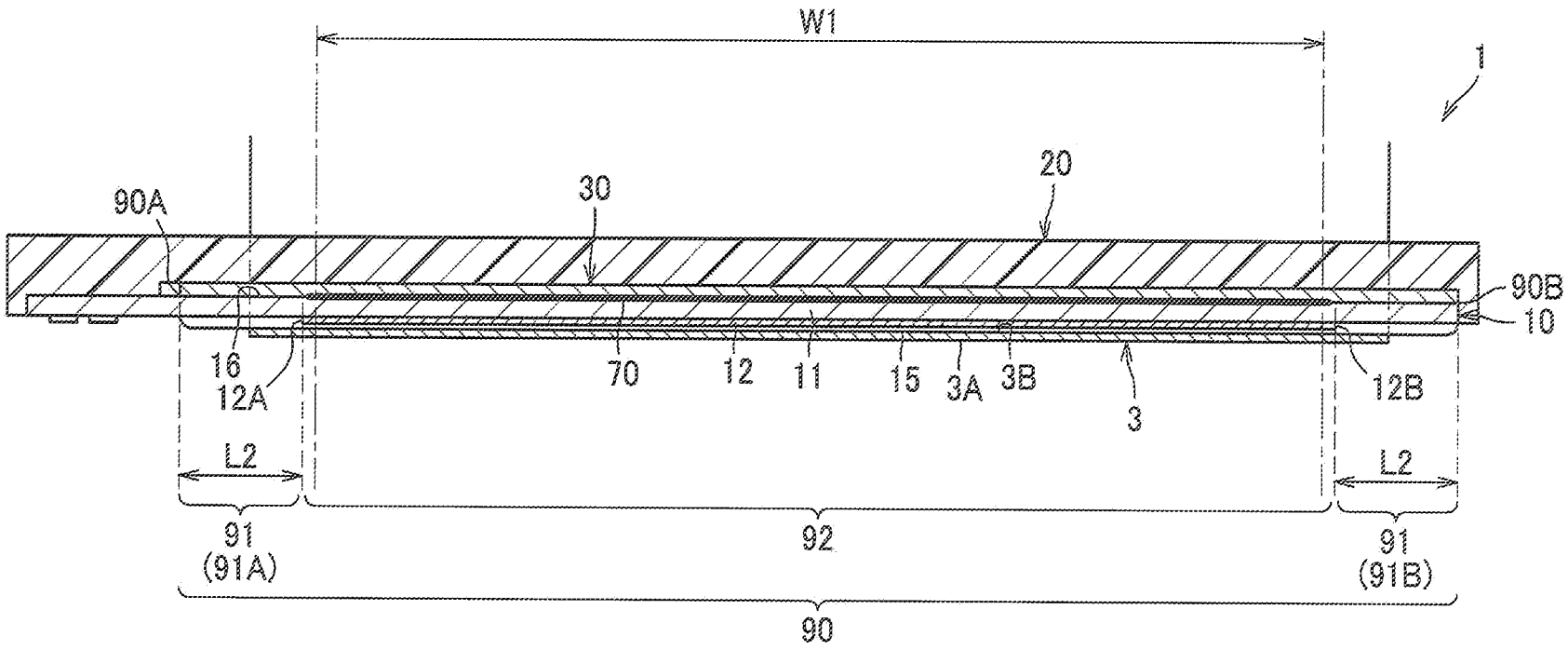
FIG. 5 is a configuration of a heating unit according to a modification.

In a modification illustrated in FIG. 5, as the same as the above described embodiments, the contact region 90 in which the back surface 16 of the heater 10 and the heat conductive member 30 are in contact with each other includes the two end regions 91 and the central region 92.

The end regions 91 are located on the outer sides of the resistance heat elements 12 in the longitudinal direction, and include the first end 90A and the second end 90B of the contact region 90. Specifically, the first end region 91A is located on the outer side of the first end 12 A of the resistance heat elements 12 in the longitudinal direction, and includes the first end 90A of the contact region 90. More specifically, the first end region 91A is a region extending from the first end 90A of the contact region 90 toward the inner side of the contact region 90 in the longitudinal direction by a predetermined length L2. Moreover, the second end region 91B is located on the outer side of the second end 12B of the resistance heat elements 12 in the longitudinal direction, and includes the second end 90B of the contact region 90. More specifically, the second end region 91B is a region extending from the second end 90B of the contact region 90 toward the inner side of the contact region 90 in the longitudinal direction by the predetermined length L2.

The predetermined length L2 is approximately the same as a distance between the position of the first end 90A of the contact region 90 in the longitudinal direction and the position of the first end 12A of the resistance heat elements 12. The predetermined length L2 is approximately the same as a distance between the position of the second end 90B of the contact region 90 in the longitudinal direction and the position of the second end 12B of the resistance heat elements 12.

The central region 92 is located in a range in which the resistance heat elements 12 is disposed in the longitudinal direction. Specifically, the central region 92 is located on the inner side of the first end 12A and the second side 12B of the resistance heat element 12 in the longitudinal direction. The heat conductive grease 70 is provided in the central region 92 in the contact region 90. The heat conductive grease 70 is not provided in the end regions 91 in the contact region 90.

Moreover, in the embodiments, the heat conductive member 30 is formed of one sheet-like member, however, the present disclosure is not limited to this configuration. For example, the heat conductive member 30 may be formed of a combination of a plurality of sheet-like members. In this case, materials, heat conductivities, and shapes of the plurality of sheet-like members may be different from one another and may be the same as one another.

Moreover, in the embodiments, the heat conductive member 30 has the sheet shape (which includes a film shape and a plate shape), however, the present disclosure is not limited to this configuration. For example, the heat conductive member may have a shape, the thickness of which is greater than that of the member having a plate shape.

Moreover, in the embodiment, the substrate 11 of the heater 10 is formed of the long rectangular plate made of ceramic, however, the present disclosure is not limited to this configuration, as long as a heat conductivity of which is less than that of the heat conductive member. For example, the substrate of the heater may be formed of a long rectangular plate made of metal such as stainless steel.

Moreover, respective components explained in the embodiments and the modification may be arbitrarily combined to achieve the disclosure.

What is claimed is:

1. A heating unit, comprising:

a heater including a substrate and a resistance heating element provided on the substrate;

an endless belt configured to rotate around the heater;

a holder supporting the heater; and a heat conductive member located between a back surface of the heater and the holder, the heat conductive member having a heat conductivity greater than that of the substrate, a length of the heat conductive member in a longitudinal direction of the heater being greater than that of the resistance heat element, wherein a contact region, in which the heat conductive member and the heater are in contact with each other, includes two end regions located on outer sides of a range in which the resistance heat element is disposed in the longitudinal direction, the two end regions respectively including a first end and a second end of the contact region in the longitudinal direction, heat conductive grease is not provided in each of the two end regions, and a central region located in the range in which the resistance heat element is disposed in the longitudinal direction, heat conductive grease is provided in the central region, and wherein a sheet-passing-range is defined as a range in which a sheet with a maximum width usable in the heating unit passes in the longitudinal direction, and the heat conductive grease is provided in an entirety of the sheet-passing-range extending from a first end to a second end of the sheet-passing-range in the longitudinal direction.

2. The heating unit according to claim 1, wherein the heat conductive member includes:

a first portion located at a position corresponding to the central region in the longitudinal direction; and a second portion located on an outer side of the first portion in the longitudinal direction and not being in contact with the heater.

3. The heating unit according to claim 2, wherein the first portion of the heat conductive member is in contact with the heater.

4. The heating unit according to claim 2, wherein the second portion is opposed to the heater with a space therebetween.

5. The heating unit according to claim 4, wherein the second portion protrudes in a direction away from the heater in a part of the heat conductive member.

6. The heating unit according to claim 2, wherein the heat conductive member includes a third portion located on an outer side of the second portion in the longitudinal direction, the third portion being in contact with the heater.

7. The heating unit according to claim 6, wherein the heat conductive grease is not interposed between the heater and the third portion.

8. The heating unit according to claim 2, wherein the heat conductive grease is interposed between the heater and the first portion.

9. The heating unit according to claim 1, wherein the heat conductive member includes:

a first portion located at a position corresponding to the central region in the longitudinal direction and being in contact with the heater; and a second portion located on an outer side of the first portion in the longitudinal direction and being in contact with the heater, a cross-sectional area of the second portion is less than that of the first portion, the cross-sectional area being an area of a cross section orthogonal to the longitudinal direction.

10. The heating unit according to claim 9, wherein the second portion has a hole.

11. The heating unit according to claim 1, wherein the end regions are located on outer sides of the sheet-passing-range.

12. The heating unit according to claim 1, wherein the heat conductive member is a metal plate.

13. The heating unit according to claim 1, wherein the heat conductive member is a graphite sheet.

14. A heating unit, comprising:

a heater including a substrate and a resistance heating element provided on the substrate;

an endless belt configured to rotate around the heater;

a holder supporting the heater; and a heat conductive member located between a back surface of the heater and the holder, the heat conductive member having a heat conductivity greater than that of the substrate, a length of the heat conductive member in a longitudinal direction of the heater being greater than that of the resistance heat element, wherein a contact region, in which the heat conductive member and the heater are in contact with each other, includes two end regions located on outer sides of a range in which the resistance heat element is disposed in the longitudinal direction, the two end regions respectively including a first end and a second end of the contact region in the longitudinal direction, heat conductive grease is not provided in each of the two end regions, and a central region located in the range in which the resistance heat element is disposed in the longitudinal direction, heat conductive grease is provided in the central region, wherein the heat conductive member includes a first portion located at a position corresponding to the central region in the longitudinal direction, and a second portion located on an outer side of the first portion in the longitudinal direction and not being in contact with the heater, and wherein the second portion is opposed to the heater with a space therebetween.

15. The heating unit according to claim 14, wherein the second portion protrudes in a direction away from the heater in a part of the heat conductive member.

16. A heating unit, comprising:

a heater including a substrate and a resistance heating element provided on the substrate;

an endless belt configured to rotate around the heater;

a holder supporting the heater; and a heat conductive member located between a back surface of the heater and the holder, the heat conductive member having a heat conductivity greater than that of the substrate, a length of the heat conductive member in a longitudinal direction of the heater being greater than that of the resistance heat element, wherein a contact region, in which the heat conductive member and the heater are in contact with each other, includes two end regions located on outer sides of a range in which the resistance heat element is disposed in the longitudinal direction, the two end regions respectively including a first end and a second end of the contact region in the longitudinal direction, heat conductive grease is not provided in each of the two end regions, and a central region located in the range in which the resistance heat element is disposed in the longitudinal direction, heat conductive grease is provided in the central region, and wherein the heat conductive member includes a first portion located at a position corresponding to the central region in the longitudinal direction and being in contact with the heater, and a second portion located on an outer side of the first portion in the longitudinal direction and being in contact with the heater, a cross-sectional area of the second portion is less than that of the first portion, the cross-sectional area being an area of a cross section orthogonal to the longitudinal direction.

17. The heating unit according to claim 16, wherein the second portion has a hole.

* * * * *